US006843429B2

(12) United States Patent
Potschin

(10) Patent No.: US 6,843,429 B2
(45) Date of Patent: Jan. 18, 2005

(54) DEVICE FOR SHAPING A FLEXIBLE INJECTION PRESSURE CURVE BY MEANS OF A SWITCHABLE ACTUATOR

(75) Inventor: Roger Potschin, Brackenheim (DE)

(73) Assignee: Robert Bosch GmbH, Stuttgart (DE)

( * ) Notice: Subject to any disclaimer, the term of this patent is extended or adjusted under 35 U.S.C. 154(b) by 29 days.

(21) Appl. No.: 10/239,512

(22) PCT Filed: Jan. 19, 2002

(86) PCT No.: PCT/DE02/00165

§ 371 (c)(1),
(2), (4) Date: Jan. 13, 2003

(87) PCT Pub. No.: WO02/057621

PCT Pub. Date: Jul. 25, 2002

(65) Prior Publication Data

US 2004/0074478 A1 Apr. 22, 2004

(30) Foreign Application Priority Data

Jan. 22, 2001 (DE) ..... 101 02 684

(51) Int. Cl.[7] ..... F02M 45/10

(52) U.S. Cl. ..... 239/95; 239/88; 239/533.9; 239/584; 239/102.2

(58) Field of Search ..... 239/102.2, 533.3, 239/533.8, 533.9, 88, 96, 584, 95; 251/129.06; 123/447, 498

(56) References Cited

U.S. PATENT DOCUMENTS 3,983,855 A * 10/1976 Jarrett ..... 123/447
4,167,373 A 9/1979 Jarrett
6,079,636 A * 6/2000 Rembold et al. ..... 239/88
6,142,443 A * 11/2000 Potschin et al. ..... 239/102.2
6,460,779 B1 * 10/2002 Boecking ..... 239/102.2

FOREIGN PATENT DOCUMENTS

EP 0823550 * 11/1998

* cited by examiner

*Primary Examiner*—Steven J. Ganey
(74) *Attorney, Agent, or Firm*—Ronald E. Greigg

(57) ABSTRACT

A device for injecting fuel into the combustion chambers of an internal combustion engine, with an injector enclosed by an injector housing, whose control chamber is acted on by a control volume, and with control valves for increasing/relieving the pressure in the nozzle chamber of the injector and in the control chamber of the injector. The control valves are disposed in parallel to one another. They are hydraulically coupled to one another without side effects by means of a coupling chamber, and are actuated by means of an actuator that can be switched into different stroke levels.

19 Claims, 8 Drawing Sheets

DEVICE FOR SHAPING A FLEXIBLE INJECTION PRESSURE CURVE BY MEANS OF A SWITCHABLE ACTUATOR

CROSS-REFERENCE TO RELATED APPLICATIONS

This application is a 35 USC 371 application of PCT/DE 02/00165 filed on Jan. 19, 2002.

BACKGROUND OF THE INVENTION

1. Field of the Invention

The invention relates to a fuel injection device for shaping a flexible injection pressure curve, with which on the one hand, a high degree of freedom can be achieved with regard to the construction and design of an injection system for highly pressurized fuel and on the other hand, the injection pressure curves can be adapted to an extremely wide range of operating conditions of an injection system. Current fuel injection system designs generally strive to reduce the number of moving components and therefore also to reduce the overall number of parts.

2. Prior Art

EP-0-823-549-A2 and EP-0-823-550-A1 have disclosed devices for injecting highly pressurized fuel into the combustion chambers of internal combustion engines, in which either a variable nozzle opening pressure can be set or a pressure increase phase (boot phase) can be produced that precedes the main injection phase. The outflow of fuel from a nozzle needle control chamber is controlled in order to adjust a variable nozzle opening pressure in the fuel injector; solenoid valves are used in these embodiments. In the embodiments known from the prior art, the solenoid valves are disposed above the control valves and consequently increase the overall height of the fuel injector. This translates into additional restrictions in the construction and installation of these valves in internal combustion engines, which must be taken into account in order to assure a proper function of the injection system.

Since the variable nozzle opening pressure in the injector disclosed by EP-0-823-550-A1 is achieved by means of the outflow of a control volume from the nozzle needle control chamber, consideration must be given to the fact that in this embodiment from the prior art, intermediary positions of the control valves that control the pressurization only change slowly and shorter switching times can only be achieved with difficulty; these shorter switching times, however, are very important in fuel injection systems, particularly at higher engine speeds.

SUMMARY OF THE INVENTION

The embodiment of a fuel injector proposed according to the invention, in which the fuel is under an extremely high pressure, permits the production of a preinjection phase, a main injection phase, as well as a pressure increase phase preceding the main injection phase, a variable nozzle opening pressure, and a secondary injection at a generally higher pressure level. In addition, the embodiment proposed according to the invention permits the diversion rate of the pump pressure to be adjusted. In the embodiment proposed according to the invention, this adjustment can be performed by an actuator that influences the pressure increase and the pressure relief in the nozzle chamber of the injector and in the control chamber of the injector; by means of a voltage regulation associated with this actuator, the actuator can be subjected to a number of voltage or current levels so that a number of different stroke levels in terms of the vertical movement of the actuator can be achieved.

The actuator can advantageously be embodied as a piezoelectric actuator. This piezoelectric actuator can perform a number of functions, thus rendering a second actuator superfluous. This permits a simpler control unit design to be achieved; in particular, a simpler plug connector can be produced due to a reduced number of plug pins to be contained, a simpler design of the driver stage can be achieved, and a reduced power loss in the control unit is achieved. As a result, the control unit as a whole can be produced for a more reasonable price.

In the embodiment according to the invention, the control valves, which produce the pressure increase and the pressure relief of the control chamber and nozzle chamber, are hydraulically coupled to each other by means of a coupling chamber; the piezoelectric actuator that actuates the control valves can be disposed so that it is spatially decoupled from them. As a result, there is a greater degree of freedom with regard to the construction of the hydraulic module for controlling the control valves, which makes it possible to situate the control valves parallel to one another. A parallel disposition of the control valves, which extend essentially in the longitudinal direction, permits a more compact structure of the hydraulic module; by contrast when solenoid valves are used, the magnets of the valves are always accommodated above the valves to be actuated. The solenoid valve embodiment therefore has a greater overall height than the proposed embodiment.

Due to their parallel disposition, the control valves can be produced independently of each other and in particular, can be adjusted independently of each other so that tolerances in one valve or a change of the functional variables in one valve does not necessarily result in a functional change in the other valve. The functional variables in the control valves include, for example, the valve stroke and the valve prestressing forces generated by compression springs associated with the respective control valves. A change in the valve stroke over the valve service life of a control valve configured according to the invention therefore does not have any effect on the stroke behavior of the other control valve in the hydraulic module. With the piezoelectric actuator, which produces extremely rapid switching times and acts on both of the control valves of the hydraulic module in a parallel fashion by means of a hydraulic coupling, there is no trouble producing the extremely short switching times required for the short preinjection phase and secondary injection phase. The piezoelectric actuator can also produce stable intermediary strokes of the valve control bodies of the control valves since the stroke that can be set in the piezoelectric actuator is significantly determined by means of the corresponding voltage or current level applied to it.

The second control valve of the hydraulic module only switches back and forth between the high-pressure level and low-pressure level and is not switched into an intermediary stroke position. As a result, the design of the second control valve is significantly simpler since it does not need to be pressure balanced. As a result, a simple standard valve can be used as the second control valve in the fuel injection system proposed according to the invention.

Another advantage that is also inherent in the embodiment proposed according to the invention is the fact that the ability to influence the diversion rate of the control volume makes it possible to reduce the noise generation in the pump component of the injection system configured according to the invention.

BRIEF DESCRIPTION OF THE DRAWINGS

The invention will be explained in detail below in conjunction with the drawings, in which.

DESCRIPTION OF THE PREFERRED EMBODIMENTS

Figure 1:
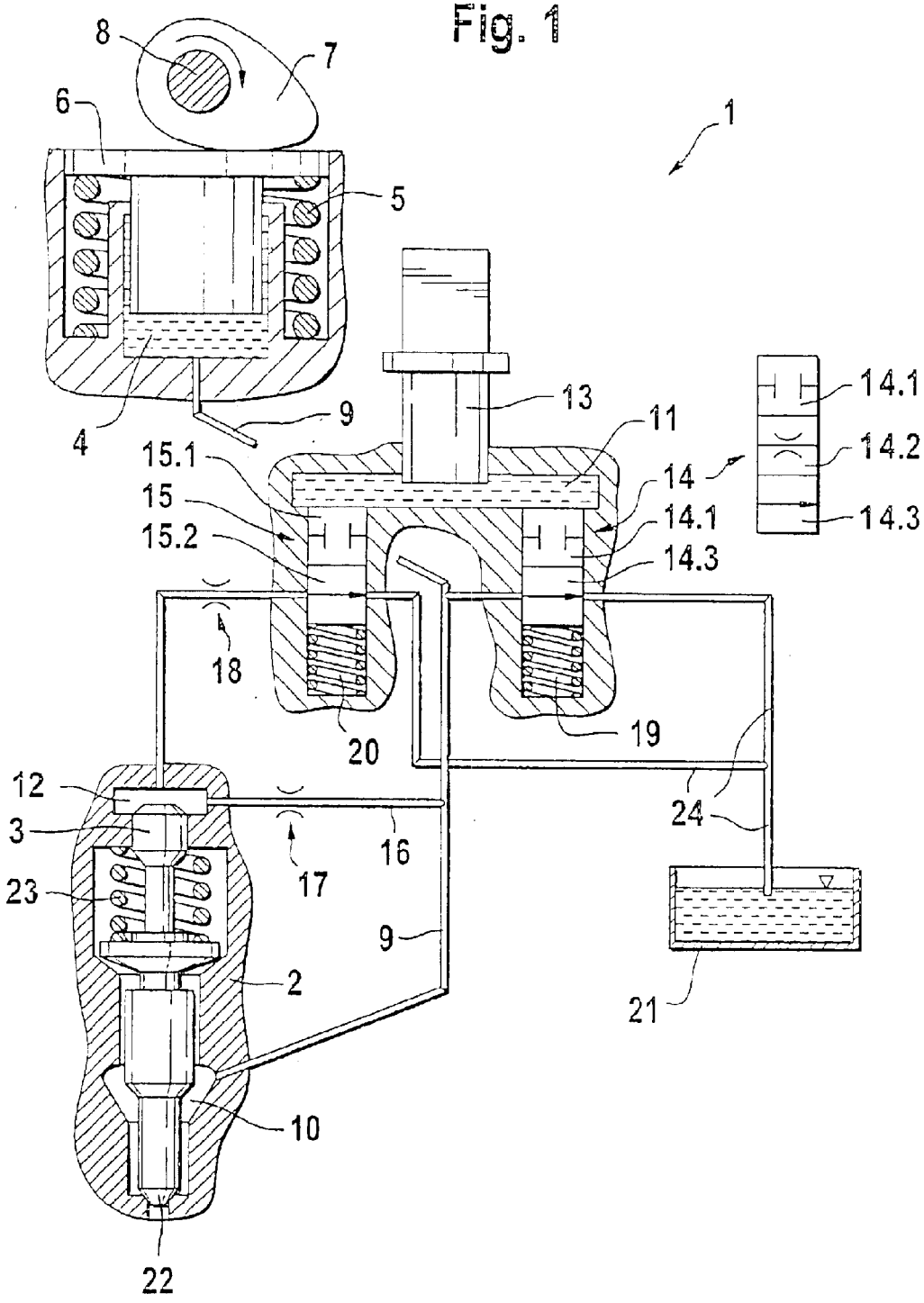
FIG. 1 is a schematic diagram of the pressure increase/pressure relief of a fuel injector according to the invention.

FIG. 1 is a schematic diagram of the pressure increase/pressure relief of a fuel injector according to the invention.

It can be inferred from the schematic diagram according to FIG. 1 that the injection system depicted includes an injector body 3 contained in a housing 2. A nozzle 22, which can be acted on by highly pressurized fuel by means of a nozzle chamber 10 contained in the injector housing 2, can be opened and closed by means of the injector body 3. The nozzle chamber 10 of the injector housing 2 is acted on with highly pressurized fuel by means of a pressure line 9. The pressure line 9 communicates with a pump chamber 4. In the pump chamber 4, a fuel volume is compressed by means of a piston, which has a piston disk 6. On one side, the piston disk 6 is prestressed by a spring element 5 and on the other side, on its top side oriented away from the spring element, it can be moved up and down in a vertically oscillating fashion by means of a cam 7, which is supported in an eccentric fashion on a shaft 8 that can be driven.

The highly compressed fuel volume emerging from the pump chamber 4 travels into the pressure line 9 and on the one hand, is introduced by means of this line into the nozzle chamber 10 of the injector housing 2 of the injection system and on the other hand, is introduced by means of a supply line 16, which contains an inlet throttle 17, into a control chamber 12, which is contained in the upper part of the injector housing 2. A return line 24 branches from the pressure line 9 and, with the interposition of a first control valve 14 that will be explained in more detail later, feeds into a fuel reservoir 21.

In addition to a supply line 16, the control chamber 12 in the injector housing 2 of the injector of the injection system shown in FIG. 1 is also connected to a return line, which contains an outlet throttle 18. The return line 24 likewise feeds into the fuel reservoir 21. The return line 24 passes an additional control valve 15, which is connected immediately downstream of the outlet throttle 18 in the return line 24.

An actuator 13, which is advantageously embodied as a piezoelectric actuator, is disposed above the two control valves 14 and 15 mentioned above. The variability of the stroke path of the actuator piston in the vertical direction can be used to produce different stroke levels in the piston through suitable switching of the piezoelectric actuator. Since the control valves 14 and 15, which are hydraulically coupled to each other by means of the coupling chamber 11 are, according to the depiction in FIG. 1, acted on in a parallel fashion by the control volume contained in the coupling chamber 11, the piezoelectric actuator acting on the control valves 14 and 15 can be spatially accommodated by them. As a result, there is a greater degree of structural freedom in embodying the control valves 14, 15. The control valves 14 and 15 can therefore be disposed, for example, parallel to each other, which significantly reduces the overall height of the injector configured according to the invention. In contrast to the use of solenoid valves, in which the control valves 14 and 15 and the magnets that trigger them have to be mounted one above the other, an injector embodied according to the invention results in a lower overall height.

It can be inferred from the configuration according to FIG. 1 that the first control valve 14 is a 2/3-port directional-control valve, which can be held in its neutral position by means of a restoring spring 19. The 2/3-port directional-control valve, i.e. the control valve 14, is closed in its first position 14.1, whereas in the position labeled 14.2, it is possible to vary a diversion rate that corresponds to the throttle cross section, i.e. the volume of the fuel pressure to be blown off into the fuel tank 21 by means of the return line 24. In the third position 14.3 that can be produced by the first control valve 14, the fuel volume flows, as shown in FIG. 1, through the diversion cross section in the open valve, by means of the return line 24, and back into the fuel reservoir 21.

By contrast, the other control valve 15 according to FIG. 1 is embodied as a 2/2-port directional-control valve, which can only produce a closed position 15.1 and an open position 15.2. The outlet throttle 18 is disposed in the return line 24, immediately upstream of the additional control valve 15. The additional control valve 15 is also associated with a restoring spring 20, which moves the control part of the additional control valve 15 back into its neutral position when the coupling chamber 11 is pressure relieved by the action of the actuator piston 13 retracting from it.

Figure 2:
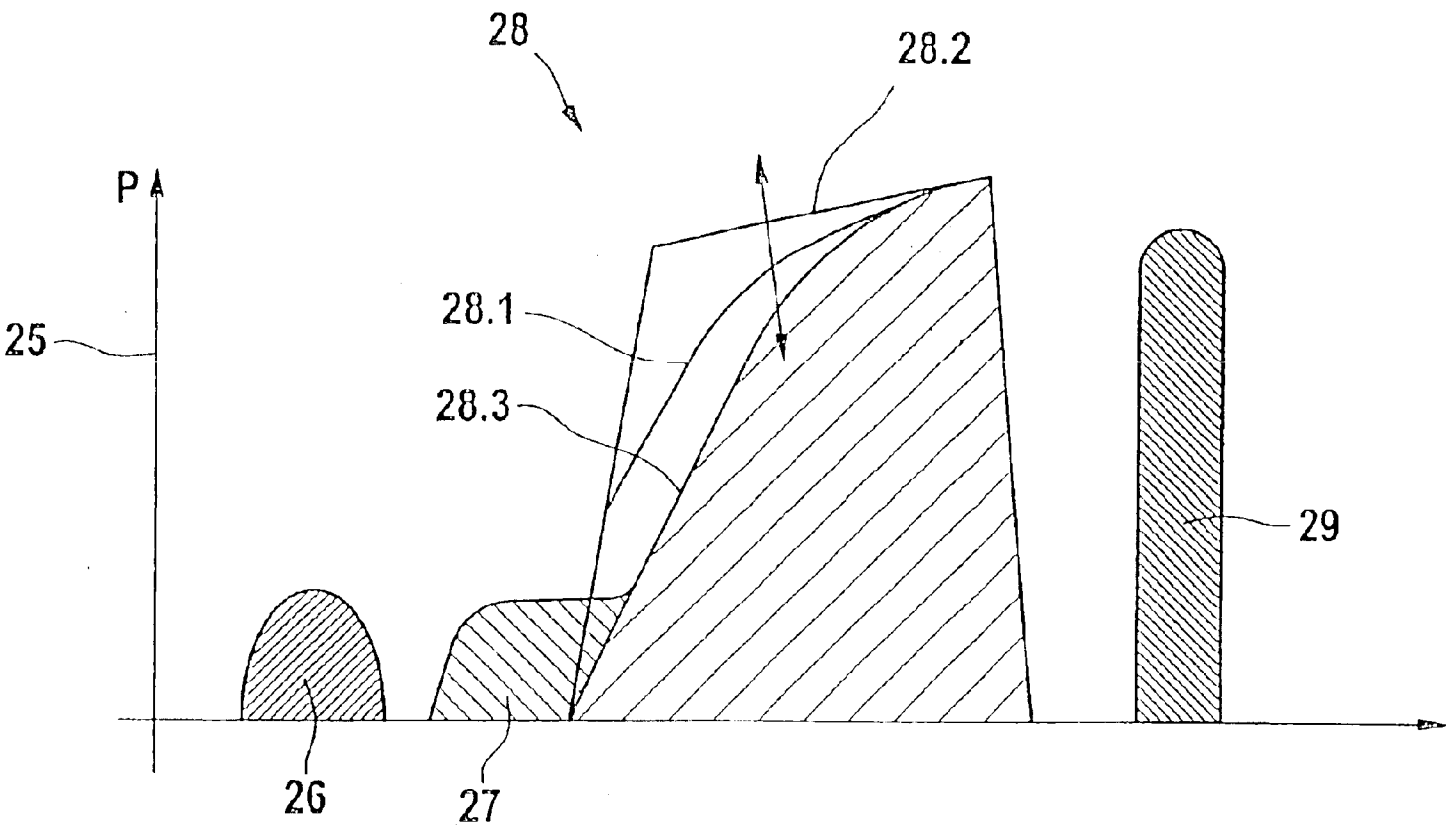
FIG. 2 shows the phases of the fuel injection process, plotted over the time axis.

The depiction according to FIG. 2 shows the schematic form of the curve of an injection process, plotted over the time axis.

The reference numeral 25 indicates the axis of the coordinate system, which shows the pressure level prevailing underneath the nozzle needle 22, whereas the other axis of the coordinate system according to FIG. 2 is the time axis. The injection can be essentially divided into a preinjection 26, a main injection following this, with a preceding pressure increase phase 27, and a secondary injection 29 that takes place after the end of the main injection. The preinjection 26 of highly pressurized fuel takes place by means of a short opening and closing of the first control valve 14 or 15 under high pressure. The first control valve 14, whether it is embodied as a 2/3-port directional-control valve or, as will be demonstrated further below, is comprised of two 2/2-port directional-control valves, can be switched into three switched positions 14.1, 14.2, and 14.3. If the piezoelectric actuator 13 is idle, the fuel delivered by the pump stroke is ejected through the diversion cross section in the open valve in position 14.3 of the valve control body. The fuel flows directly through the return line 24 into the fuel reservoir 21.

In the additional switched position 14.2 of the first control valve 14, which can be produced through a variation of the voltage regulation or the current level in the piezoelectric actuator 13, this control valve 14 is switched to a smaller diversion cross section, indicated by the throttle symbol shown in position 14.2 in FIG. 1. In 14.2, it is consequently possible for there to be a deliberate blowing off of the highly pressurized fuel so that the full pump pressure does not prevail, but rather a lower injection pressure level prevails, which according to reference numeral 27 in the depiction according to FIG. 2, is maintained during the pressure increase phase that precedes a main injection. The pressure that prevails during the pressure increase phase 27 depends on the diversion cross section that can be produced in the switched position 14.2 of the first control valve 14, the pump speed, the pump piston area, the profile of the cam 7, and the nozzle flow through the injection nozzle 21.

In the position 14.1, the first control valve 14 closes completely so that a pressure increase with a maximal gradient of 28.3 can occur (see the curve of the opening pressure 28 at the beginning of the main injection). For the pressure curves 28.1 and 28.3, the first valve and the second control valve 15 must remain closed (14.1 and 15.1). A pressure builds up in the pump without the nozzle needle 3 and 22 opening. The opening pressure is selected by means of the time at which the additional control valve 15 is switched into position 15.2. The nozzle needle 3/22 opens at an increased pressure so that a pressure curve is produced, which is between a triangular curve and an almost rectangular curve 27, 28.3 without a boot phase, or 28.2. According to the double arrow shown in FIG. 2, other pressure curves can also be produced at the beginning of the main injection phase.

During the pressure increase phase 27 as well as the subsequent main injection phase, the additional control valve 15 remains in its open position 15.2 so that in the control chamber 12 in the injector housing 2, a (low pressure prevails, which corresponds with the dimensioning of the inlet throttle 17 and outlet throttle 18. The nozzle needle of the nozzle 22, which is acted on by the force of the control piston 3, can open. If the additional control valve 15 is closed by a further increase in the control voltage or current level in the actuator 13, then the high pump pressure prevails in the control chamber 12 so that the needle of the nozzle 22 is closed again. In order to produce the secondary injection 29 shown in FIG. 2, the additional control valve 15 is opened for a short time and is then closed again.

This permits an active needle stroke control for the needle of the nozzle 22 to be produced in order to terminate the main injection phase, although the pressure in the pump chamber 4 is maintained.

When the actuator 13 is reset into its initial position, the first control valve 14 moves into position 14.3 and thus unblocks the entire diversion cross section. As a result, the pressure in the pump chamber 4 is reduced as rapidly as possible, whereas in the middle position 14.2 of the first control valve 14, only a small diversion cross section is unblocked so that the pressure relief (spill rate) occurs more slowly and the pump noise decreases.

Figures 3, 4:
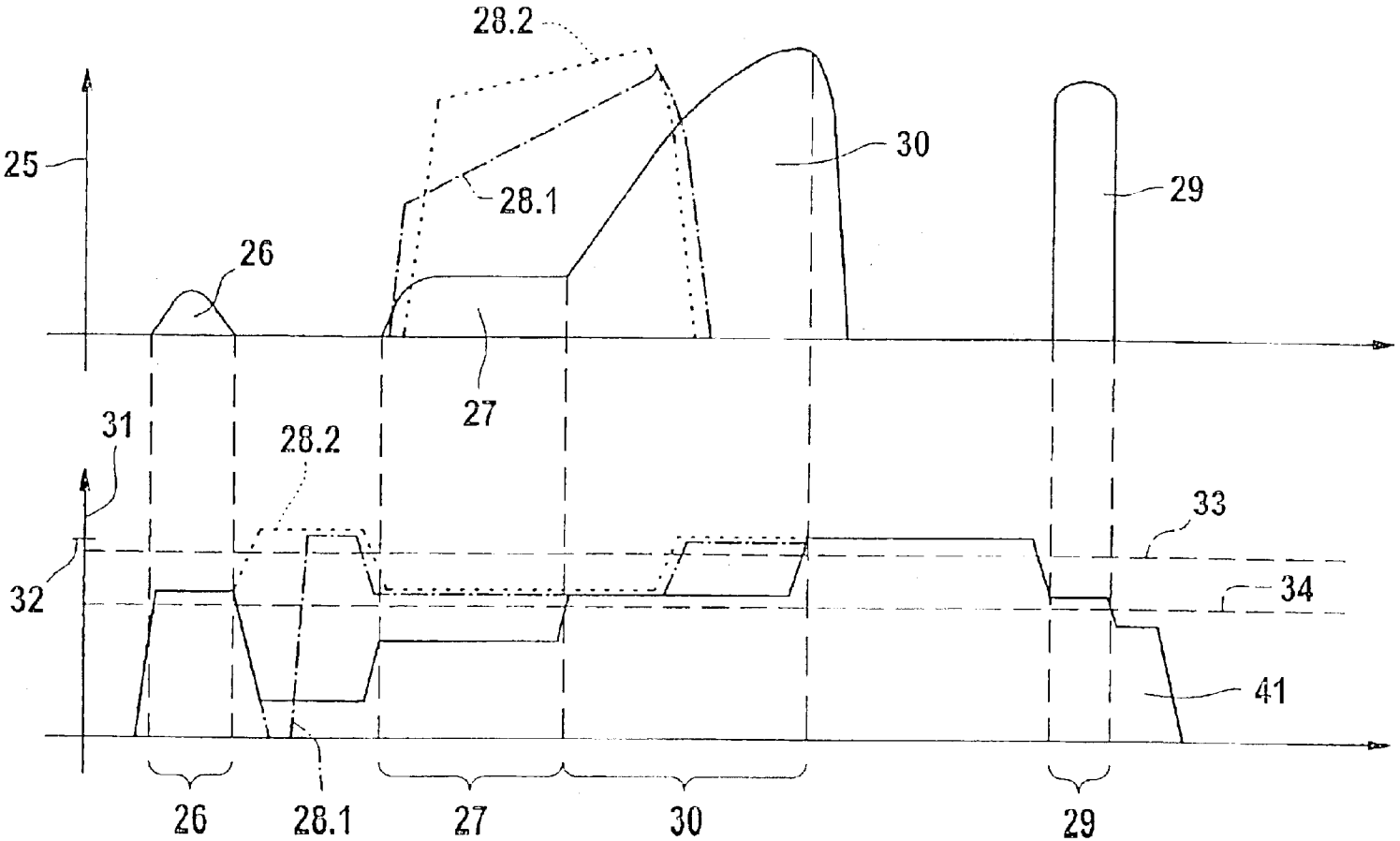
FIGS. 3, 4 show the comparison of injection nozzle pressure and actuator stroke.

FIGS. 3 and 4 show the comparison of the injection pressure that occurs and the associated actuator stroke position in more detail.

The reference numeral 25 indicates the pressure curve that occurs in the injection nozzle 22, which can be essentially divided into a preinjection phase 26, a subsequent pressure increase phase 27, and a main injection phase 30. This is followed by a secondary injection phase 29.

In the graph at the bottom, the actuator stroke curve 31 produced is plotted over the time axis; the reference numeral 32 on the axis 31, which identifies the actuator stroke path, indicates a maximal stroke path. The horizontal dashed lines that are labeled with the reference numerals 33 and 34 (this is where the first valve and the second control valve close) can more precisely characterize a first stroke level 33 and a second stroke level 34 of the actuator 13, which is preferably embodied as a piezoelectric actuator. In order to produce the preinjection 26, the piston of the actuator 13 travels past the first stroke level 34 into the coupling chamber 11 and thus produces an injection of a small fuel quantity into the combustion chamber of the internal combustion engine. This is a first exemplary embodiment. The curves 28.1 and 28.2 can also be produced by means of the triggering possibility shown with dashed lines. Then the actuator 13 travels back into its neutral position so that it can then slide partially back into the coupling chamber 11 and trigger the two control valves 14 and 15 that are hydraulically coupled to each other there in order to produce a pressure increase phase 27. The piston of the actuator 13 displaces a greater volume from the coupling chamber 11 during the main injection phase 30 and is switched into its maximal position 32 toward the end of the main injection phase. The actuator piston remains in this position until, during the secondary injection 29, it is reset to the stroke level that prevails during the main injection phase 30. Then, after the end of the secondary injection phase 29, a pressure relief phase 41 begins.

Figure 5:
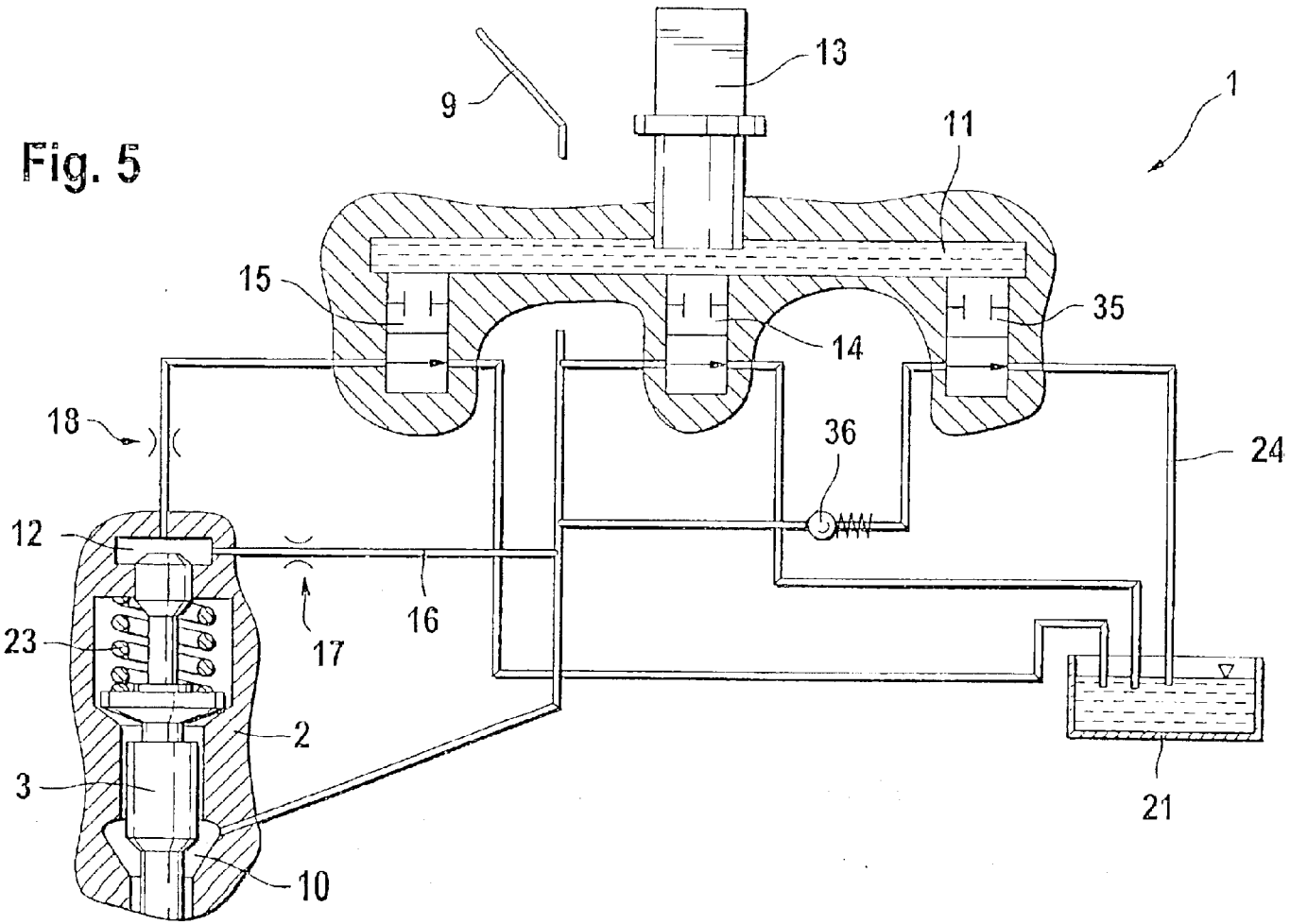
FIG. 5 shows an alternative possible embodiment of the injection system with 2/2-port directional-control valves instead of a 2/3-port directional-control valve according to FIG. 1.

FIG. 5 shows an alternative possible embodiment of the injection system with 2/2-port directional-control valves, which replace the 2/3-port directional-control valve according to FIG. 1. In this embodiment variant, a piston of an actuator, for example a piezoelectric actuator 13, likewise acts on the coupling chamber 11. In contrast to the schematic diagram shown in FIG. 1, the first control valve 14 is comprised of two parallel-connected 2/2-port directional-control valves 14 and 35. In addition, the 2/2-port directional-control valve 35 has a constant pressure valve 36 connected upstream of it.

Analogous to the schematic diagram of the injection system 1 shown in FIG. 1, the additional control valve 15 is preceded by an outlet side throttle 18, which can communicate with the fuel reservoir 21 in position 15.2 of the additional control valve 15. Analogous to the schematic diagram shown in FIG. 1, by means of the supply line 16, the control chamber 12 of the injector 3 is acted on with highly pressurized fuel by means of an inlet throttle 17; the inlet line 16 branches from the pressure line 9 to the nozzle chamber 10 of the injector housing 2. In the embodiment variant shown in FIG. 5, the 2/3-port directional-control valve shown in FIG. 1, which can be switched into three switched positions 14.1, 14.2, and 14.3, is replaced. Instead of being performed by one 2/3-port directional-control valve, these functions can be performed by two 2/2-port directional-control valves. The advantage that can be achieved with the 2/2-port directional-control valves 14 and 34 is that they are significantly easier to produce and the additional valve can also be used to produce a connection with a constant pressure valve 36 or a throttle disposed outside the control valve 14. By means of a constant pressure valve 36, the pressure generated during the pressure increase phase 27 no longer depends on the speed, but can be set to a constant value in accordance with the opening pressure of the constant pressure valve 36.

A parallel arrangement of the valves to each other can also be achieved when two 2/2-port directional-control valves that comprise the first control valve 14 are provided. Tolerances in one of the valves or a change of the functional variables, such as the valve stroke and valve prestressing forces produced by the restoring springs 19 and 20, do not cause any functional change to the respective other valve. So a change in the valve stroke over the valve service life of the one valve does not have any effect on the stroke of the remaining valve.

In the embodiment variant of the injection system 1 shown in FIG. 5, it is also true that the additional control valve 15 can be embodied in the form of a simple 2/2-port directional-control valve, which only switches back and forth between high pressure and low pressure and therefore does not need to be pressure balanced. As a result, it can be used as a simple standard valve and therefore as an interchangeable part in the injection system configured according to the invention.

Figure 6:
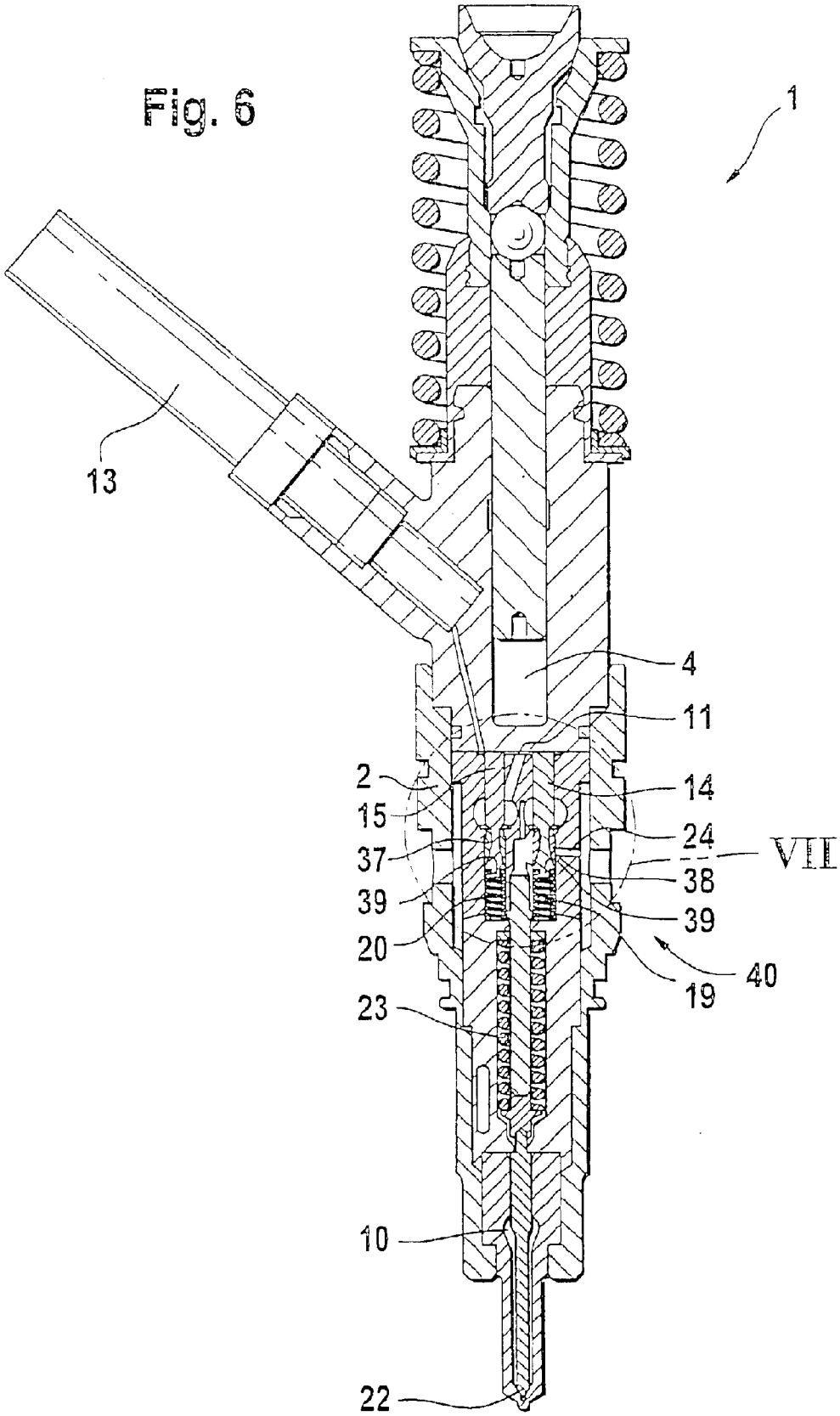
FIG. 6 shows a possible embodiment of an injector incorporating the invention.

FIG. 6 shows a possible embodiment of an injector in more detail.

Lateral to the injector of the injection system 1, a piston is provided, which can move in a pump chamber 4 and can act on a hydraulic module 40 of the injector 3 with fuel by means of a pressure line 9. The hydraulic module 40 includes two control valves 14 and 15 disposed in parallel, of which the control valve 15 is comprised of 2/2-port directional-control valves with two switched positions 15.1 and 15.2, whereas the first control valve 14 can either be configured as a 2/3-port directional-control valve, which can be switched into three positions, or can be comprised of two 2/2-port directional-control valves as shown in FIG. 5.

Each of the control valves 14 and 15 is provided with a specially configured restoring spring 19 and 20; in the front part of the injector housing 2 of the injector 3, a nozzle chamber 10 is provided, which encompasses the nozzle needle and can be used to act on the nozzle 22 with a fuel volume to be injected into the combustion chamber of an internal combustion engine.

Figure 7:
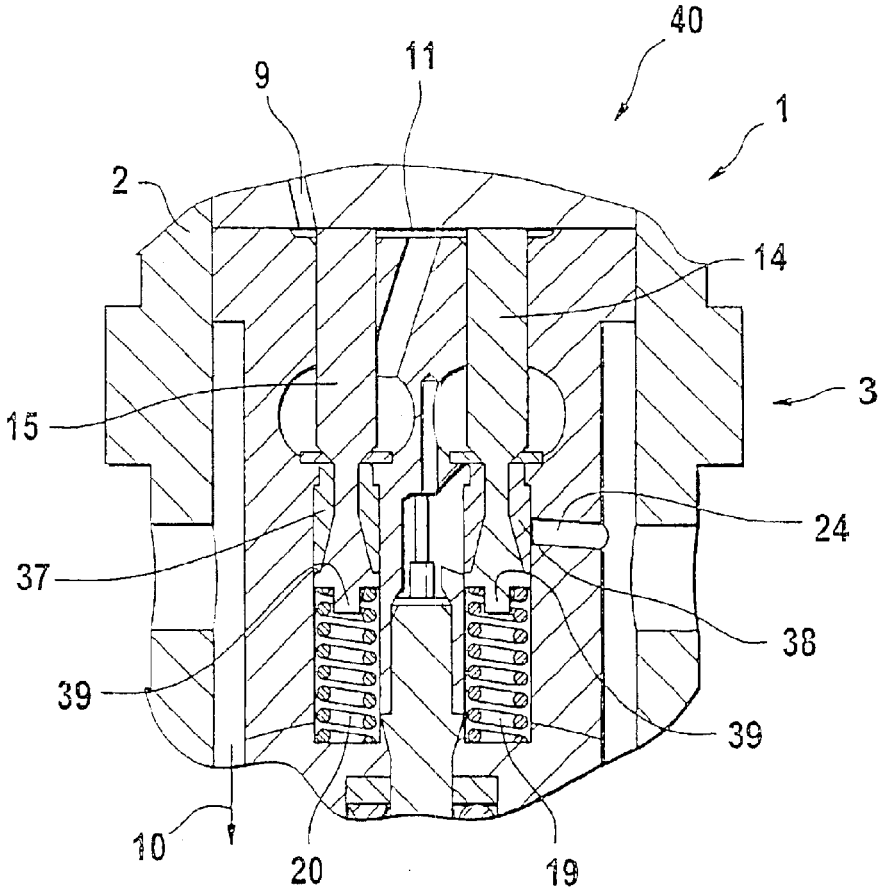
FIG. 7 shows a detailed depiction of the injector according to FIG. 6.

FIG. 7 shows the hydraulic module 40 of the injector 3 according to FIG. 6, in a slightly enlarged scale. It can be inferred from the configuration according to FIG. 7 that the two control valves 14 and 15 each include a control valve body 37 and 38, whose ends have projections 39 that protrude into the coils of the restoring springs 19 and 20. The first control valve 14 is laterally associated with a return line 24, whereas the connecting line 9 that connects the divided coupling chamber 11 is shown above the additional control valve 15.

Figure 8:
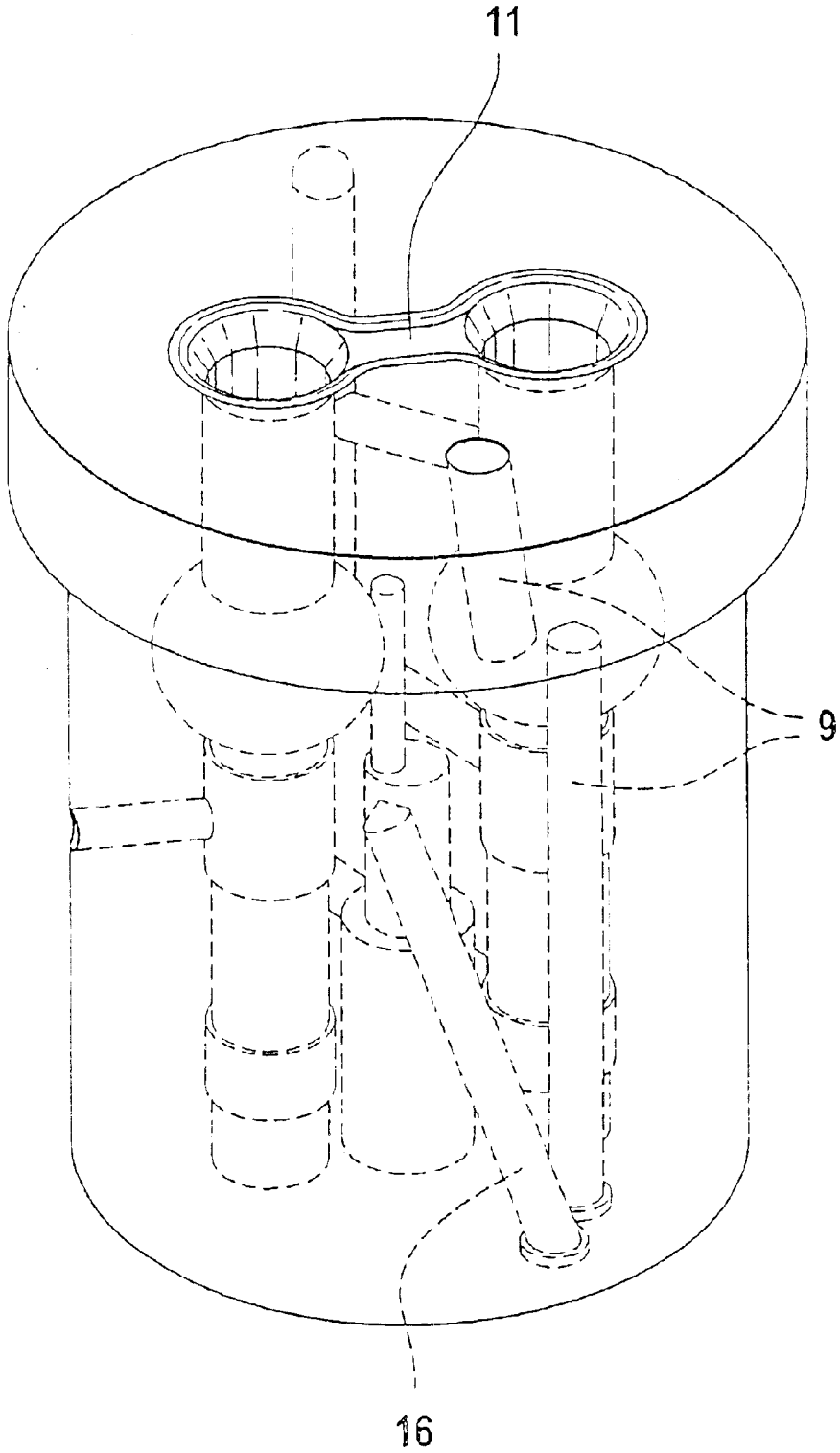
FIG. 8 is a three-dimensional view of the hydraulic module of a fuel injector embodying the invention.

FIG. 8 is a three-dimensional view of the hydraulic module of the injector in more detail.

The two control valves 14 and 15 contain control valve bodies 37 and 38, which can be controlled in a parallel fashion to each other and are hydraulically connected by means of a coupling chamber 11, which is connected to each of the two control valves or is common to both of them, and by means of a control volume there that can be displaced by the piezoelectric actuator 13; FIG. 8 also shows pressure lines 9 and a supply line 16.

The reference numerals 14 and 38 or 15 and 37 each indicate the control valves. In FIG. 8, these valves are not shown; this Fig. only shows the module body without the valves in order to show the individual courses of the bores.

Figure 9:
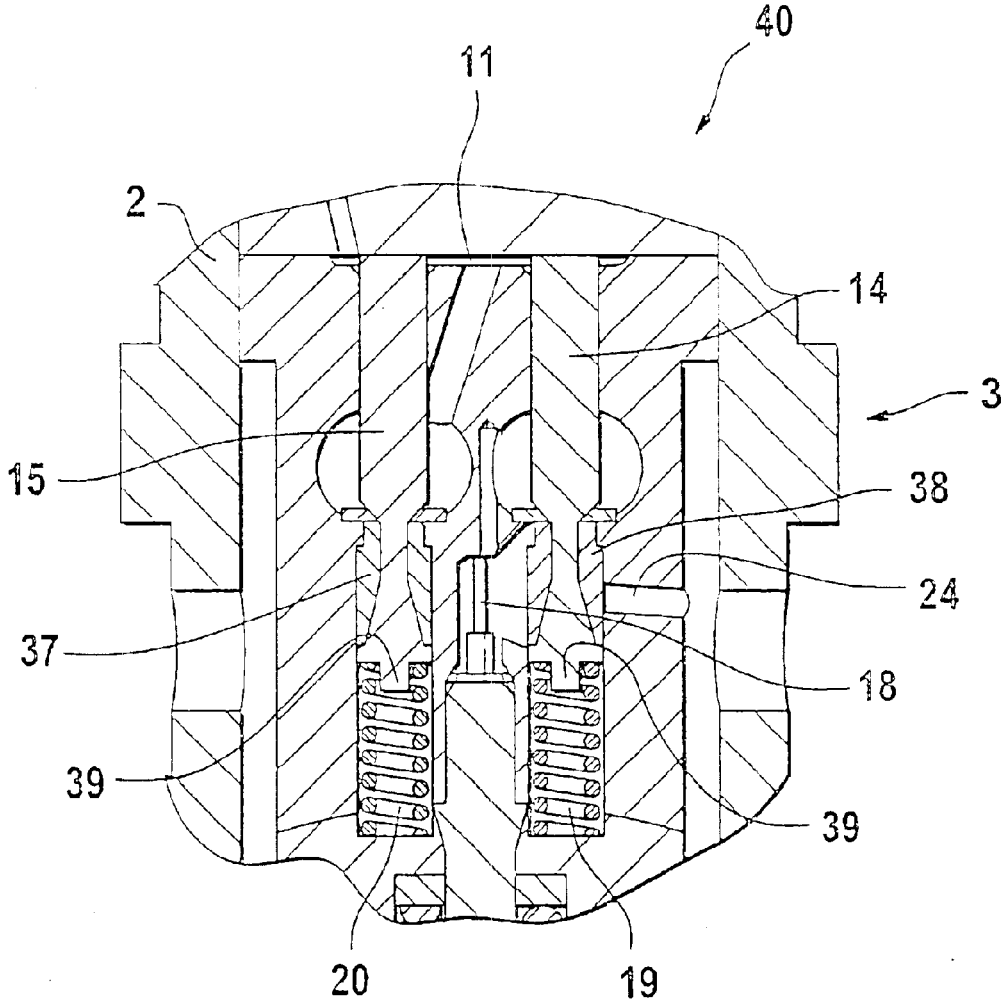
FIG. 9 shows a cross section through the three-dimensionally depicted hydraulic module according to FIG. 8.

FIG. 9 shows a cross section through the three-dimensionally depicted hydraulic module 40 according to FIG. 8.

One of the circumference bores of the circumference surface of the injector housing 2 is fed by the return line 24, which can be closed and opened by the first control valve 14 or can be acted on by it with a diversion rate that can be variably predetermined. The coupling chamber 11, which is common to both of the control valves 14 and 15, is shown above the valve body 37 and 38. In the depiction in FIG. 9, the reference numeral 18 indicates the outlet throttle of the control chamber 12, into which the plunger rod 3 of the injection system proposed according to the invention is inserted.

The foregoing relates to preferred exemplary embodiments of the invention, it being understood that other variants and embodiments thereof are possible within the spirit and scope of the invention, the latter being defined by the appended claims.

I claim:

1. A device for injecting fuel into the combustion chambers of an internal combustion engine, comprising an injector (3) enclosed by an injector housing (2) and including a control chamber (12) that can be acted on by a control volume and a nozzle chamber (10), control valves (14, 15) for increasing/relieving the pressure in the nozzle chamber (10) of the injector (3) and in the control chamber (12) of the injector (3), the control valves (14, 15; 35) being disposed in parallel to one another and hydraulically coupled to one another without side effects by means of a coupling chamber (11), and an actuator (13) that can be switched into different stroke levels for actuating the control valves (14, 15), wherein the first of the control valves (14) is embodied as a 2/3-port directional-control valve that can be moved into three switched positions (14.1, 14.2, 14.3).

2. The device according to claim 1, wherein the control valves (14), (15; 35) are hydraulically coupled by means of a coupling chamber (11) that can be acted on with a fluid volume.

3. The device according to claim 1, wherein in order to achieve extremely short switching times, the actuator (13) is embodied as a piezoelectric actuator.

4. The device according to claim 3, wherein the actuator (13) can be switched by means of voltage/current regulation into a number of stroke levels that move the control valves (14, 15) into different switched positions (14.1, 14.2, 14.3; 15.1, 15.2).

5. The device according to claim 1, wherein the actuator (13) can be switched to a neutral position, wherein in the neutral position of the actuator (13), the first control valve (14) unblocks the full diversion cross section for the pressure relief in an open position (14.3), and before the open position (14.3) is reached, a gradual pressure relief occurs in a middle position (14.2).

6. The device according to claim 1, wherein a short opening and closing of the first control valve (14) or of the additional control valve (15) produces a preinjection phase (26).

7. The device according to claim 1, wherein a secondary injection (29) is produced by opening and closing the additional control valve (15).

8. A device for injecting fuel into the combustion chambers of an internal combustion engine, comprising an injector (3) enclosed by an injector housing (2) and including a control chamber (12) that can be acted on by a control volume and a nozzle chamber (10), control valves (14, 15) for increasing/relieving the pressure in the nozzle chamber (10) of the injector (3) and in the control chamber (12) of the injector (3), the control valves (14, 15; 35) being disposed in parallel to one another and hydraulically coupled to one another without side effects by means of a coupling chamber (11), and an actuator (13) that can be switched into different stroke levels for actuating the control valves (14, 15), wherein the first of the control valves (14) is embodied with a diversion cross section that controls the diversion rate of the compressed fuel in order to produce a boot phase (27) in the injector (3) of the injection system (1).

9. The device according to claim 8, wherein the additional control valve 15 can be switched into two switched positions including a closed position 15.1, and an open position 15.2, and remains in its open position 15.2 during the pressure increase phase 27 and the main injection phase 30.

10. The device according to claim 8, wherein the control valves (14), (15; 35) are hydraulically coupled by means of a coupling chamber (11) that can be acted on with a fluid volume.

11. The device according to claim 8, wherein in order to achieve extremely short switching times, the actuator (13) is embodied as a piezoelectric actuator.

12. The device according to claim 8, wherein a short opening and closing of the first control valve (14) or of the additional control valve (15) produces a preinjection phase (26).

13. The device according to claim 8, wherein a secondary injection (29) is produced by opening and closing the additional control valve (15).

14. A device for injecting fuel into the combustion chambers of an internal combustion engine, comprising an injector (3) enclosed by an injector housing (2) and including a control chamber (12) that can be acted on by a control volume and a nozzle chamber (10), control valves (14, 15) for increasing/relieving the pressure in the nozzle chamber (10) of the injector (3) and in the control chamber (12) of the injector (3), the control valves (14, 15; 35) being disposed in parallel to one another and hydraulically coupled to one another without side effects by means of a coupling chamber (11), and an actuator (13) that can be switched into different stroke levels for actuating the control valves (14, 15), wherein the first of the control valves (14) is comprised of two parallel-connected 2/2-port directional-control valves and wherein a pressure for the pressure increase phase (27) can be set.

15. The device according to claim 14, wherein the control valves (14), (15; 35) are hydraulically coupled by means of a coupling chamber (11) that can be acted on with a fluid volume.

16. The device according to claim 14, wherein in order to achieve extremely short switching times, the actuator (13) is embodied as a piezoelectric actuator.

17. The device according to claim 14, wherein the additional control valve 15 can be switched into two switched positions including a closed position 15.1, and an open position 15.2, and remains in its open position 15.2 during the pressure increase phase 27 and the main injection phase 30.

18. The device according to claim 14, wherein a short opening and closing of the first control valve (14) or of the additional control valve (15) produces a preinjection phase (26).

19. The device according to claim 14, wherein a secondary injection (29) is produced by opening and closing the additional control valve (15).

* * * * *